United States Patent [19]

Bernardi

[11] 4,068,673

[45] Jan. 17, 1978

[54] AWNING TYPE SUNSHADE

[76] Inventor: Dario Bernardi, Via Mazzini, 5, Cattolica (Forli), Italy

[21] Appl. No.: 700,644

[22] Filed: June 28, 1976

[30] Foreign Application Priority Data

July 3, 1975 Italy ..... 44017/75

[51] Int. Cl.[2] ..... E04F 10/06; A45F 1/14

[52] U.S. Cl. ..... 135/5 R; 135/7.1 R; 160/24; 160/71

[58] Field of Search ..... 135/5 R, 5 A, 5 AT, 135/5.2, 7.1 R, 7.1 A, 20 A; 160/22, 24, 68, 69, 70, 265, 71

[56] References Cited

U.S. PATENT DOCUMENTS

| | | | |
|---|---|---|---|
| 2,859,756 | 11/1958 | Barnes | 135/5 A |
| 3,730,196 | 5/1973 | Borskey | 160/22 X |
| 3,952,758 | 4/1976 | Addison et al. | 135/5 AT |

FOREIGN PATENT DOCUMENTS

| | | | |
|---|---|---|---|
| 934,546 | 9/1955 | Germany | 135/5 R |

*Primary Examiner*—Werner H. Schroeder
*Assistant Examiner*—Conrad L. Berman
*Attorney, Agent, or Firm*—Guido Modiano; Albert Josif

[57] ABSTRACT

An awning type sunshade particularly for beaches, gardens and the like, comprising a supporting frame associated with a support member. At an intermediate point of the supporting frame the ends of a pair of telescoping arms are articulated. At their other ends, the arms are connected with the ends of a front member which is movable with respect to the supporting frame. The arms are pivotable at an intermediate point about a substantially perpendicular axis with respect to the front member direction of movement. The end of an awning is connected with the front member. The awning is connected at the other end thereof, with a take-up roller rotatably supported by the supporting frame. A means is provided for blocking or locking the rotation of the arms and/or the telescoping movement thereof.

8 Claims, 10 Drawing Figures

1
2
3
4
5
6
7
8
8a
9
10
11
11a
12
13
13a

13b 20
21
9,10

22

13c
23

24

AWNING TYPE SUNSHADE

BACKGROUND OF THE INVENTION

This invention relates to an awning type sunshade or awning particularly for sheltering from the sun's rays beach areas, gardens and the like.

SUMMARY OF THE INVENTION

It is a primary object of this invention to provide an awning tye sunshade which, thanks to its peculiar construction, is specially handy and easy to orient in any position as desired by the user, without requiring special artifices of any kind.

It is another object of the invention to provide an awning type sunshade which, thanks to its articulation capabilities, can offer any degree of shelter irrespective of the sun's relative position and in any utilization conditions.

It is a further object of this invention to provide an awning type sunshade which is easy to use, as required, for shelter from the wind, without endangering its user (s).

These and other objects, such as will become apparent hereinafter, are achieved by an awning type sunshade particularly for beaches, gardens and the like, according to the invention, characterized in that it comprises a supporting frame associated with a support member, at an intermediate point of said supporting frame there being knuckle jointed the ends of a pair of telescoping arms associated, at their other ends, with the ends of a front member which is movable with respect to said supporting frame, said arms being pivotable at said intermediate point about a substantially perpendicular axis with respect to said front member direction of movement, there being associated with said front member the end of an awning associated, at the other end thereof, with a take-up roller rotatably supported by said supporting frame, a means being provided for blocking the rotation of said arms and/or the telescoping movement thereof.

BRIEF DESCRIPTION OF THE DRAWINGS

Further features and advantages will be more apparent from the ensuing description of some preferred, though not exclusive, embodiments of the invention, illustrated by way of example and not of limitation in the accompanying drawings, where.

DESCRIPTION OF THE PREFERRED EMBODIMENTS

Figures 1, 2, 3, 4, 5, 6, 7:
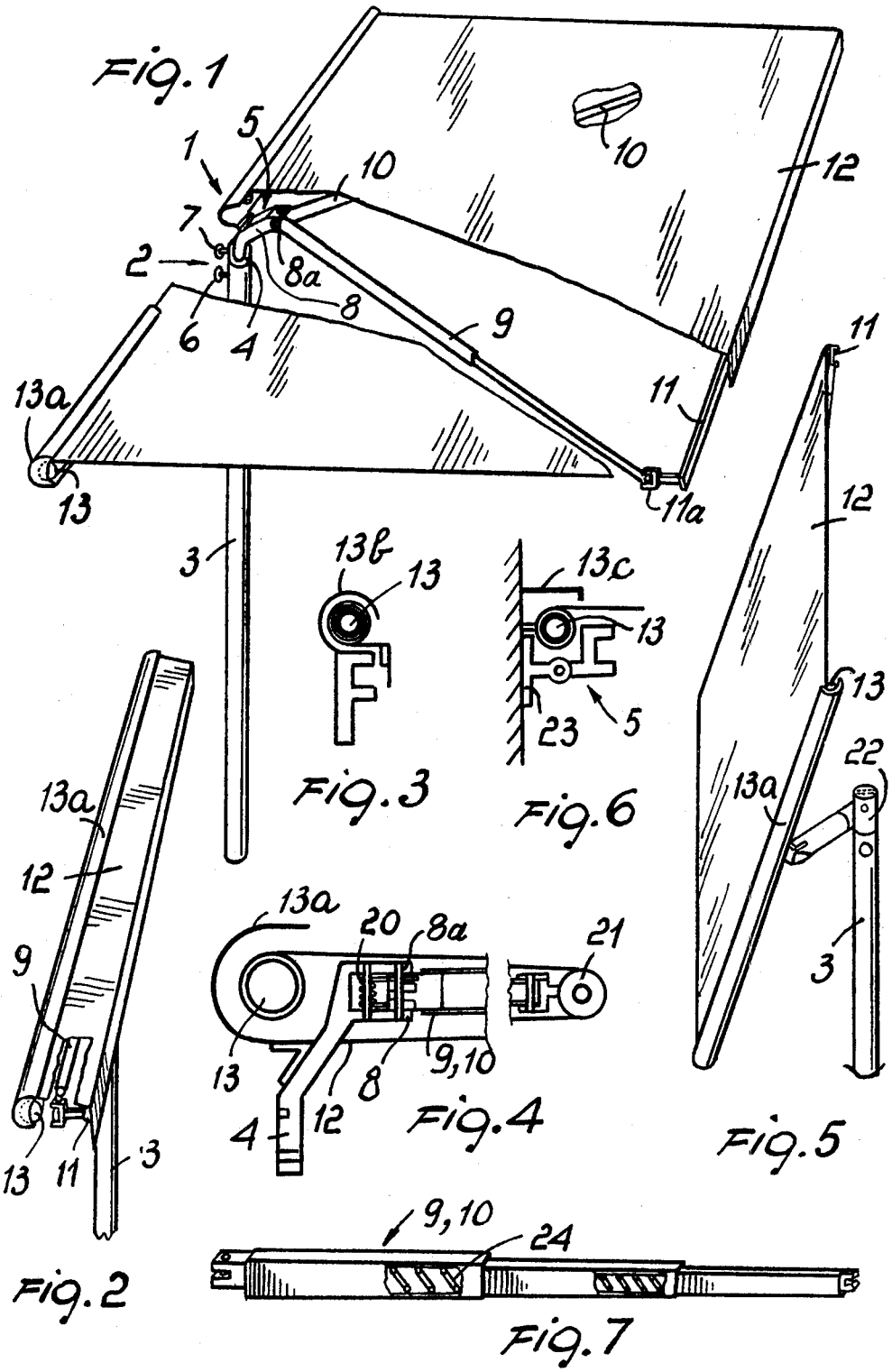
FIG. 1 shows diagrammatically, in perspective and partly cut-away view, an awning according to this invention, in the opened position thereof.
FIG. 2 shows diagrammatically, in perspective and partly cut-away view, an awning in the closed position thereof.
FIG. 3 shows diagrammatically an embodiment of a part of the inventive awning.
FIG. 4 is a diagrammatically elevational side view of a further embodiment of the awning.
FIG. 5 shows another embodiment of the awning, as used for shelter from the wind.
FIG. 6 shows diagrammatically one embodiment of the awning for use mounted to a wall.
FIG. 7 shows diagrammatically yet another embodiment of the awning supporting telescope arms.

With reference to the cited figures, and in particular to FIG. 1, the inventive awning is comprised of a supporting frame, denoted generally by the numeral 1 and associated, through a knuckle joint, generally denoted with 2, with a support member comprising, for example, a pole 3 suitably anchored to the ground. Said knuckle joint 2 comprises a body 4 associated for rotation about the pole 3 and about an axis which is coincident with the pole own axis; to said body 4 a hinge block 5 is associated which is integral with said supporting frame 1, and rotatable about an axis substantially perpendicular to the pole 3 axis. The rotational movements of the body 4 and hinge block 5 are lockable, respectively through a knob 6 and knob 7.

Said hinge block 5 is provided, remotely from the connection point to the body 4, with a bracket member 8 which is located at an intermediate point of said supporting frame 1, whereto by means of a hinge connection **8*a* the ends are articulated of a pair of telescoping arms, respectively denoted with the numerals 9 and 10. At their other ends, the telescoping arms 9, 10 which may comrprise two or more sections, are associated such as by means of hinge connections 11*a* with the ends of a front member 11 which is movable with respect to said supporting frame 1**.

Said arms 9, 10, at said intermediate point, are rotatable about a substantially perpendicular axis with respect to said member 11 direction of movement relative to said supporting frame 1.

To said front member 11 there is affixed the end of an awning or canvas piece 12 which, at its other end, rolls onto a take-up roller 13 rotatably supported by said supporting frame 1 about an axis which is substantially parallel to the front member 11 longitudinal extension. Moreover, a box member **13*a* is provided, also supported by the supporting frame 1 and effective to cover, at least in part, said take-up roller 13. In order to open or rig the awning, all that is required is a pull, outwardly directed, on the front member 11: thereby the two telescoping arms 9 and 10 acquire a rotational movement with respect to the bracket 8, and there occurs, moreover, a relative sliding movement of the telescoping elements of the arms. Preferably, said take-up roller 13 is provided with a bias spring effective to roll over the roller of the canvas awning 12, whereby during the awning 12 opening step, the canvas unroll itself from the take-up roller 13 overcoming the action of the roller 13 spring. In order to lock the awning in open or spread position, it is enough that one of the movements of the arms 9 and 10 components be locked by locking means, i.e. either the rotational movement be locked to the arms with respect to the bracket 8 or the telescoping sliding movement of the arm elements. In order to close or fold down the awning, all that is required is that the lock provided by said means be removed such that the awning 12 may be rolled up, through the take-up roller 13 spring, onto the take-up roller 13, while the arm elements will acquire a motion opposing the opening or unfolding one, i.e. a rotational movement about the bracket 8 and a relative sliding movement between the elements that make up the telescoping arms 9 and 10**.

Referring now to FIG. 2, the awning type sunshade is shown in its closed or folded position. In this position, the canvas 12 is completely rolled around the takeup roller 13 and the elements of the telescoping arms 9 and 10 are arranged one within the other, and the arms are fully spread apart, with respect to the intermediate point represented by the bracket 8, and are practically along the sides of the front member 11.

Referring to FIG. 3, there is shown a box, denoted with the numeral 13*b*, thereby the awning 12 in its closed position, i.e. fully wrapped around the take-up roller 13, is completely enclosed by the box 13*b*.

With reference to FIG. 4, there is shown an embodiment wherein the telescoping arms 9 and 10 are fully enclosed at the top and bottom portions thereof by the awning 12 which, in this position, forms accordingly an air gap or interspace.

In this embodiment, there acts on the telescoping arms 9 and 10, at their hinge connection point to the bracket 8, an expansion spring 20 tending to rotate the arms 9 and 10 in the opening direction, and, moreover, an idle roller 21 is supported pivotally on the front piece 11 and arranged parallel with respect to the take-up roller 13, which in this embodiment is not provided with the self-winding spring. In this embodiment of the invention, furthermore, the awning 12 has one edge anchored to the box 13*a* and, after unwinding from said idle roller 21, winds itself back around the take-up roller 13, such that the arms 9 and 10 are positioned inside the awning canvas, thereby an air gap or interspace is formed which is effective as a thermal insulator.

With reference to FIG. 5, there is shown an awning according to this invention wherein the supporting pole or post 3 is provided, at a middle portion thereof, with a hinge connection 22 featuring an axis which extends, preferably, parallel to the awning plane, in its opened or unfolded condition, such as to permit a position for the awning 12 whereat one side of the awning is closed to ground level as shown, and the awning acts then as a practical wind braker or screening apparatus.

In FIG. 6, there is shown an embodiment wherein, in lieu of the stand or supporting pole 3, supporting brackets are provided, denoted generally with the numeral 23, which provide for the anchoring of the hinge block 5 and box 13*c* to a flat surface such as a wall; if desired, the hinge block 5 may be connected to the brackets 23 through a knuckle joint in order to further extend the adjustment capabilities of the inventive awning.

An embodiment of the telescoping arms 9 and 10 appears in FIG. 7 which comprises, for example, three component elements which are slidable to telescope one within the other and provided internally with a coil spring 24 accomplishing, in a practically automatic way, the extension movement of the arms.

Figures 8, 9, 10:
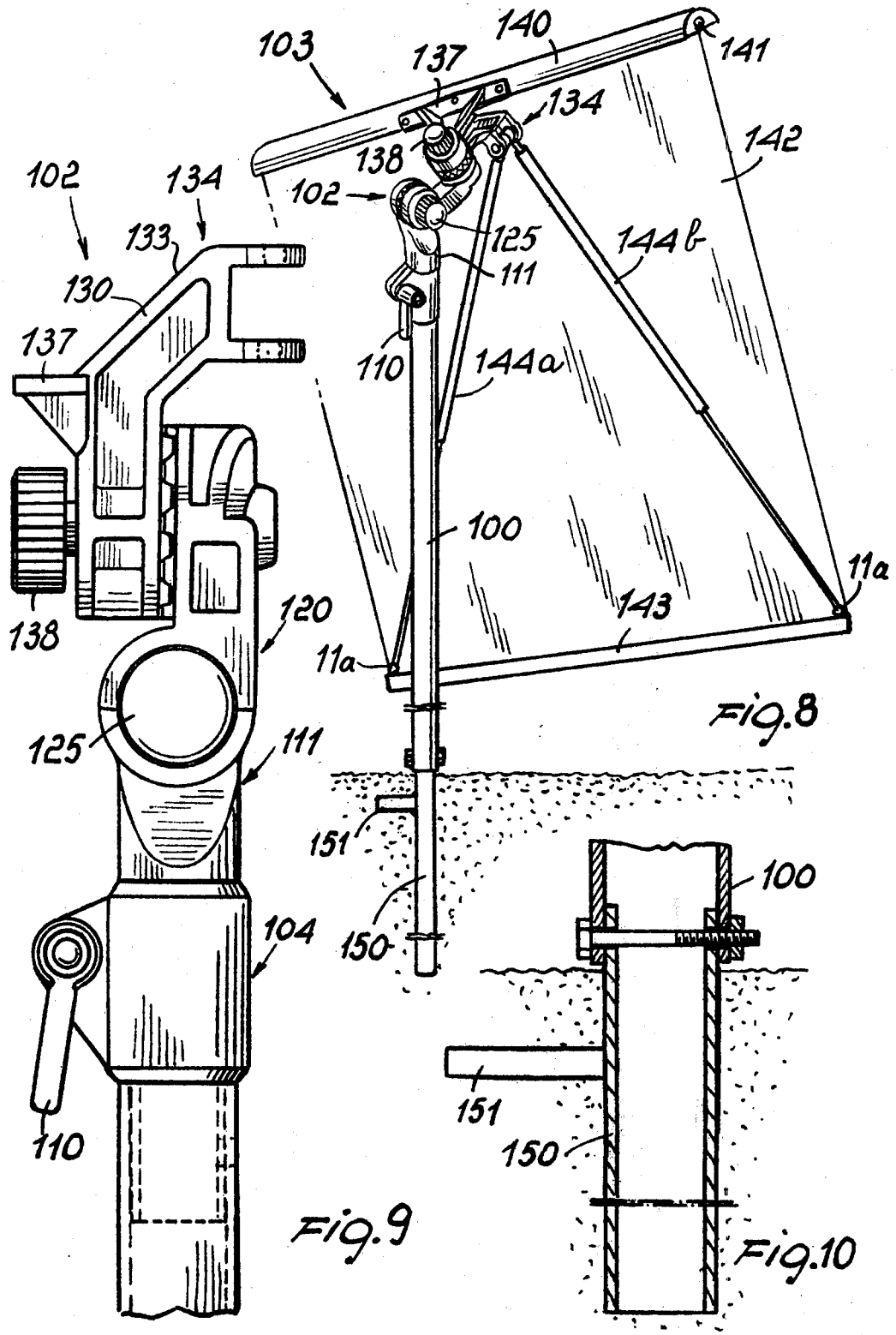
FIG. 8 is a perspective view of the awning according to the invention, showing in detail the knuckle joint between the supporting frame and the support member.
FIG. 9 is an elevational view of the multiple knuckle joint.
FIG. 10 shows, partially in a cut-away view, the detail of the connection to the lower end of the pole stand.

With reference to FIGS. 8 to 10, the awning type sunshade according to the invention, comprises a stand or supporting pole, denoted generally with the reference numeral 100, whereto a supporting frame 103 is connected through a knuckle joint shown generally at 102, such as will be described in detail hereinbelow. Said knuckle joint 102, which is located at the end of said pole 100, is provided with a sleeve member 104 which may be inserted into and fixed to said pole 100. With said sleeve member 104 there engages, pivotally about a first axis substantially coincident with said pole 100 axis, a first element 111. With said first element 111 a second element 120 engages which is rotatable about a second axis substantially perpendicular to said first axis. With said second element 120 a third element 130 engages, pivotally about a third axis substantially perpendicular to said second axis.

Provision is made, moreover, for means for movably locking against rotation said first element 111, said second element 120 and said third element 130, said means consisting of wing nuts or knobs indicated by 110, 125 and 138 respectively.

A lug 133 extends rigidly from said third element 130 which is provided at its free end with a bracket member 134 with which the end of two telescoping arms engages. Furthermore, again rigidly mounted to said third element 130, a bracket 137 is provided the function whereof will be described hereinafter.

As mentioned above, a supporting frame 103 is provided at the end of said multiple joint, including also said bracket 137 and bracket member 134. Said frame 103 further comprises a box member, generally denoted with 140, which is attached to said bracket 137 and pivotally supports a take-up roller 141 whereto the end is connected of a canvas piece 142 associated, with its other end, to a front member 143. Said front member 143 is supported by the end of said telescoping arms 144*a* and 144*b*, which at their other end are articulated on said bracket member 134. It thus happens that during the unwinding of the canvas piece 142 from the take-up roller 141, the canvas piece is supported between the roller 141 and the front member 143, connected as previously described. It should be further added that the roller 141 is preferably self-rewinding, i.e. provided internally with a spring; in order to prevent the canvas 142 from rewinding itself about the roller 141, there is provided a locking member capable of locking either the telescoping extension of the arms 144*a* and 144*b* or, alternatively, the rotation thereof about the pin provided on the bracket member 134, such rotation occurring during the withdrawal of the canvas piece 142, as previously noted.

At its bottom portion, the pole 1 is supported by a tubular end bit, denoted generally with the numeral 150; said end bit may be inserted, for example, into sand or the ground and is provided, close to its upper end, with a side arm 151 extending radially from the end bit; the arm 151, has the important function of preventing the end bit from rotating in windy conditions, which rotational movement would occur about the axis of the end bit 150 if the arm 151 were not provided. The arm 151 may be rigidly attached to the end bit or, alternatively, it may be articulated on the latter; in this latter case, a stop is provided which prevents the arm from rotating beyond the position perpendicular to the end bit, while allowing rotation toward the bottom end of the bit 150, thus facilitating the storage of end bits 150. The bit 150 is located with its top end slightly projecting from the ground and on it the lower end of the pole 100 is inserted and locked by means of a through bolt and the like.

Discussing now again the multiple knuckle joint 102, it may be seen that it allows for a wide range of rotational movements, thus providing for the user of the inventive awning type sunshade the possibility of arranging it as desired, so as to obtain the desired shaded area independently of the sun relative positions, and moreover of employing the awning as a wind screen by arranging a side thereof close to the ground.

It will moreover appear that the disclosed multiple knuckle joint by providing rotation capabilities about three axes perpendicular or orthogonal to each other, may cover the full inclination range to be conferred to the canvas piece 142, with great simplicity and quite quickly, since the multiple joint 102 as described behaves in practice as a ball joint, while offering superior stability and lockability features, thereby any unwanted rotational movement is effectively prevented.

The invention as described hereinabove is susceptible to numerous modifications and variations, all of which fall within the scope of the present inventive concept.

Furthermore, all the details may be replaced with other elements, technically equivalent, without departing from the concept behind the present invention.

In practicing the invention, the materials used, and the dimensions or shapes adopted may vary within a wide range.

I claim:

1. An awning type sunshade structure particularly for beaches, gardens and the like, comprising a take-up roller defining a center line thereof, a flexible awning element woundable on said take-up roller and having an end thereof connected to said take-up roller, an elongated front member cooperating with said awning element and extending substantially parallel to said center line, a supporting frame for supporting said take-up roller rotatably about said center line thereof, a pair of telescoping arms, first hinge means for hingedly connecting first ends of said telescoping arms to said supporting frame and second hinge means for connecting second ends of said telescoping arms to said elongated front member, all said hinge means defining respective axis of rotation extending in a direction substantially parallel to each other and transverse to said center line, said telescoping arms being arranged to converge towards a common intersecting point thereof.

2. A structure according to claim 1, wherein said telescoping arms have internally at least one spring urging said telescoping arms in an extended position thereof.

3. A structure according to claim 1, wherein said front member includes an idle roller substantially parallel to said take-up roller and wherein said awning element has one portion thereof extending from said take-up roller to said idle roller and an other portion thereof extending from said idle roller to said take-up roller, said two portions of the awning element enclosing said telescoping arms therebetween, and wherein said frame includes an elongated box like member surrounding at least in part said take-up roller.

4. A structure according to claim 1, wherein said supporting frame includes a support member having said first hinge means and connected to said frame in an intermediate position thereof and an elongated box like member for covering said take-up roller.

5. A structure according to claim 4, further comprising a pole for said support member and adjustable locking means for adjustably locking said support member to said pole.

6. A structure according to claim 5, wherein said adjustable locking means include a first joint allowing rotation of said support member about an axis transverse to said pole.

7. A structure according to claim 5, wherein said adjustable locking means include a first joint allowing rotation of said support member about a first axis of rotation parallel to said pole and wherein said support member is a composite support member having a first element connected to said first joint, a second and a third element, a first knuckle joint connecting said first and said second element and allowing rotation about a second axis of rotation extending transverse to said first axis of rotation, and a second knuckle joint connecting said second and said third elements and allowing rotation about a third axis of rotation extending transverse to said first and said second axis of rotation.

8. A structure according to claim 5, wherein said pole includes a tubular end bit member for driving it into the ground and having near its top end a side arm extending radially therefrom to prevent rotation of said bit member when driven into the ground and locking means for removably locking said pole onto said bit member.

* * * * *